United States Patent [19]

Elliston

[11] Patent Number: 4,776,246

[45] Date of Patent: Oct. 11, 1988

[54] COMBINATION SCREWDRIVER HAND TOOL

[76] Inventor: Edward E. Elliston, 2521 N. Lawndale Ave., Chicago, Ill.

[21] Appl. No.: 430,789

[22] Filed: Sep. 30, 1982

[51] Int. Cl.[4] ..... B25B 23/00

[52] U.S. Cl. ..... 81/439; 81/438

[58] Field of Search ..... 81/439, 438

[56] References Cited

U.S. PATENT DOCUMENTS

| | | | |
|---|---|---|---|
| 772,593 | 10/1904 | Wagner | 81/438 |
| 1,448,895 | 3/1923 | Yotta | 81/438 |
| 1,965,917 | 7/1934 | Anderholm | 81/439 |
| 2,641,478 | 6/1953 | Sigg | 81/439 |

FOREIGN PATENT DOCUMENTS

| | | | |
|---|---|---|---|
| 1242520 | 6/1967 | Fed. Rep. of Germany | 81/439 |

*Primary Examiner*—Frederick R. Schmidt
*Assistant Examiner*—Bradley I. Vaught

[57] ABSTRACT

A hand-held combination screwdriver having a plastic handle that receives a reversible round steel driver with a flat blade screwdriver at one end and Phillips driver blades at its other end. An elongated channel or slot with side recesses is formed in the handle and receives both ends of the driver, and the side recesses are shaped to engage and lock the flat blade end of the driver without additional parts. A "U" shaped locking key at the bottom of the channel holds and locks the Phillips end of the driver and also defines a stop for the flat blade end.

11 Claims, 2 Drawing Sheets

COMBINATION SCREWDRIVER HAND TOOL

BACKGROUND OF THE INVENTION

The present invention relates to hand tools and more particularly to hand tools that have plastic handles adapated to receive either end of a driver shaft having different screwdriver blades at its opposite ends. One example of this type of tool includes a driver having a conventional flat blade at one end for driving slotted screws and crossed Phillips blades formed at its other end.

The difficulty in this type of combination tool is that because the opposite ends of the driver have different configurations it is difficult to form a socket assembly in the handle that will securely lock both ends from rotation. There have in the past been provided metal ferrules and locking rings that cooperate with the driver shaft itself to prevent relative rotation between the driver and the handle. In one of these screwdrivers, a plurality of axial ribs are stamped or forged approximately mid-length on the driver. A metal insert having grooves for receiving these ribs is pressed into the forward end of the plastic handle surrounding the opening of the driver's socket. These ribs extend one or two inches in length and engage the recessed ring in both positions of the driver.

While this screwdriver assembly is satisfactory, it is difficult and expensive to manufacture because it requires a plurality of stamping operations to form the ribs on the driver and it also requires the forming and machining of the locking ring and its press fit into the open end of the socket in the handle. Moreover, because the driver is supported at its midportion, it tends to pivot somewhat in the handle.

Examples of similar screwdrivers are also shown in the Cleary, et al, patent, U.S. Pat. No. 2,527,492 and the Rock patent, U.S. Pat. No. 2,658,766.

While it would be desirable to shape the socket in the plastic handle so that the socket itself locks the driver from rotation without the need for any additional locking rings or driver swaging operations, no such handle has been designed to this date. The primary problem, of course, is that the socket in the handle must accommodate the different shapes of the Phillips head end of the driver and the flat blade end, so that a handle socket that might lock one end of the driver might not be able to lock or even accommodate the other end. Moreover, because the handle is plastic it has been found difficult if not impossible to shape the handle sockets so that it locks the torquing ends of the metal driver without deforming and damaging the sides of the plastic socket.

It is a primary object of the present invention to ameliorate the problems noted above in hand-held combination screwdrivers.

SUMMARY OF THE PRESENT INVENTION

In accordance with the present invention, a combination screwdriver is provided with a handle that reversely receives a double tooled screwdriver in an elongated channel with a unique shape that locks one end of the driver without the need for metal inserts, locking rings, other metal locking parts, or special driver machining.

The driver has conventional Phillips screwdriver blades formed at one end and a conventional flat driver blade at its other end. It is important to an understanding of the present invention to know how the flat bladed end of the driver is formed even though the construction and method of forming the ends of the drive are conventional. To form the flat bladed end, the end of a round, steel rod is stamped or forged to form flat, forwardly converging top and bottom walls. This operation spreads or "pancakes" the end of the rod to a width much greater than the diameter of the rod itself. Thereafter, the sides of this "pancaked" end of the rod are sheared or ground to form forwardly converging side walls that are spaced apart throughout most of their length a distance greater than the diameter of the unworked rod.

Now if one looks axially down the formed driver from the flat bladed end of the rod, the driver has an outer periphery, along the extreme outer edges seen, that defines the shape of the cross-section of the channel in the handle throughout its length. The channel, however, is slightly larger in size than the outer perimeter of the driver when viewed from the flat blade end so that the driver may be inserted into the channel.

This unique shape of the channel in the handle prevents the flat blade drive end from rotating by engagement between the channel and the edges of the top and bottom walls of the flat blade end throughout a susbstantial axial length of the top and bottom walls from where they begin on the round driver shaft up to a point where the converging sidewalls begin. This is over fifty percent of the total length of the top and bottom walls and thus provides a very secure lock for the flat bladed end of the driver without any metal parts or special machining of the driver itself.

The channel, in cross-section, has a central generally circular central portion with diametrically protruding side recesses. The central portion has a diameter slightly greater than the diameter of the driver rod and the width of the channel between the bottoms of the diametrical recesses is slightly greater than the maximum diameter of the flat blade at the beginning of the side walls. These recesses are defined by curved walls tangent to the central portion of the channel having radii with their axes in planes extending through the flat bottoms of the recesses.

The Phillips blade end of the driver is also held in the handle channel and is prevented from rotating with respect to the handle by a generally "U" shaped metal locking key. The key has a width slightly less than the maximum width of the channel across the bottoms of the recesses and during assembly, it is pushed down into the channel along the recesses until it bottoms in the channel. The ends of the legs of the "U" shaped locking key are flat and coplanar and serve as a stop for the flat blade end of the driver when inserted into the handle. The recesses in the channel engage both sides of the "U" shaped locking key and securely prevent it from rotating in the channel.

DETAILED DESCRIPTION OF THE PREFERRED EMBODIMENT

Figures 1, 2, 3, 4, 5, 6, 7, 8, 9, 10, 11, 12, 22:
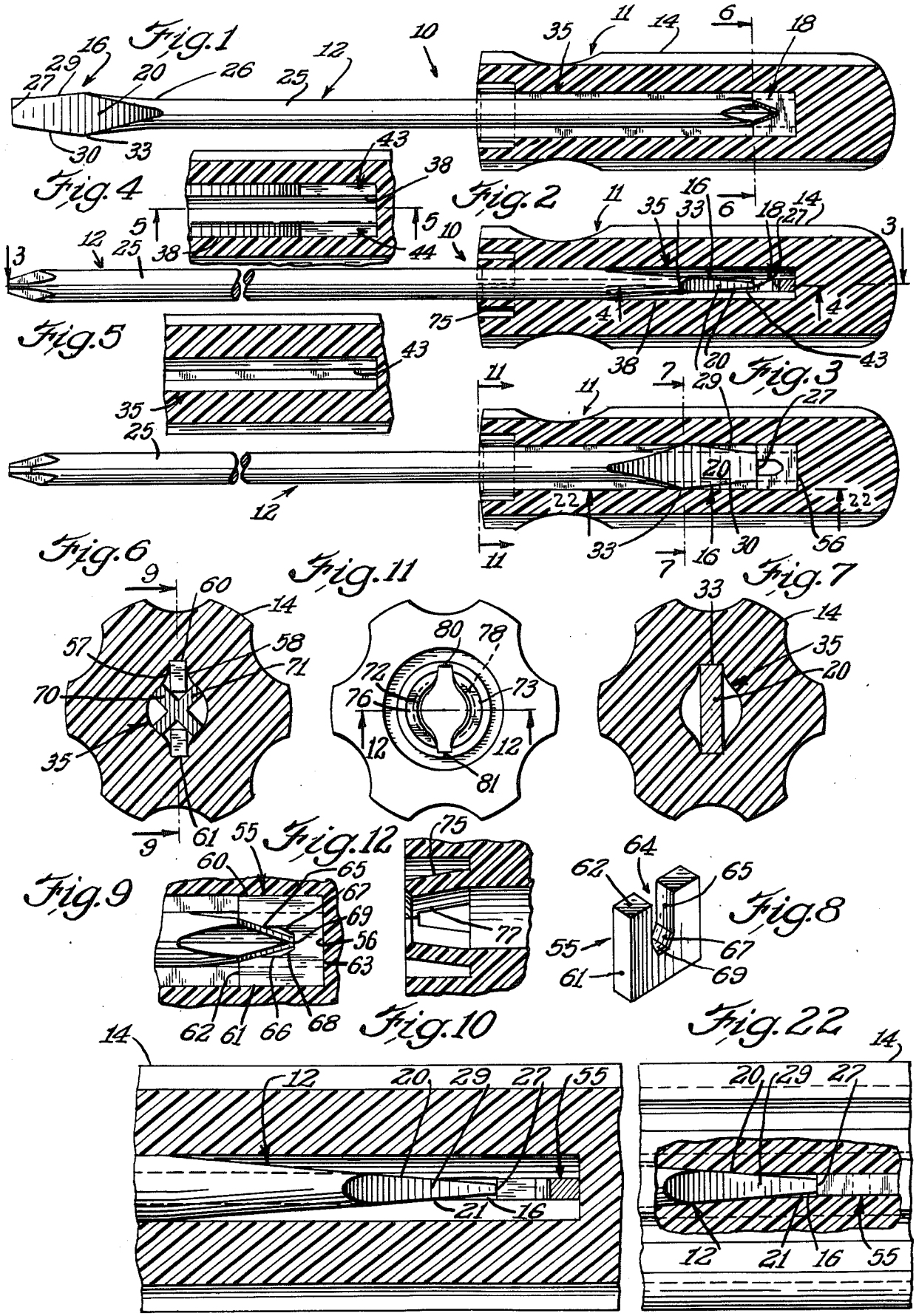
FIG. 1 is an elevation view of a combination screwdriver according to the present invention with the handle shown in longitudinal section and the Phillips blade end of the driver inserted into the handle.
FIG. 2 is an elevation view with the handle in longitudinal section similar to FIG. 1, with the flat blade end of the driver inserted into/the handle.
FIG. 3 is an elevation view with the handle in longitudinal section similar to FIG. 2, taken generally along line 3—3 of FIG. 2.
FIG. 4 is a fragmentary section showing the end of the channel in the handle taken generally along line 4—4 of FIG. 2.
FIG. 5 is a fragmentary section of the handle illustrating the end of the handle taken generally along line 5—5 of FIG. 4.
FIG. 6 is an enlarged cross-section taken generally along line 6—6 of FIG. 1 showing the Phillips blade interfitted with the locking key.
FIG. 7 is an enlarged cross-section taken generally along line 7—7 of FIG. 3, illustrating the widest part of the flat bladed end of the driver in the handle channel.
FIG. 8 is a perspective view of the locking key according to the present invention.
FIG. 9 is an enlarged fragmentary view illustrating the Phillips blades on the driver interfitted with the locking key.
FIG. 10 is an enlarged fragmentary view of a handle with the flat blade end of the driver positioned similar to its position illustrated in FIG. 2.
FIG. 11 is a left end view of the handle taken generally along line 11—11 of FIG. 3 with the driver removed.
FIG. 12 is a reduced fragmentary section of the outer end of the handle taken generally along line 12—12 of FIG. 11.
FIG. 22 is a fragmentary view taken generally along line 22—22 of FIG. 3 showing the tapered portions on the side recesses of the channel.

Referring to the drawings and particularly FIGS. 1 to 10, the present combination screwdriver is illustrated and generally designated by the reference numeral 10 and is seen to include a one-piece molded plastic handle 11 with a double ended driver 12 adapted to be inserted in either end into the handle 11.

The handle 11 is a one-piece plastic molding constructed of a durable impact resistant plastic such as one of the phenolics. Handle 11 is generally cylindrical and elongated in configuration and has a plurality of longitudinally extending outer ribs 14 to improve the operator's grip on the handle.

The driver 12 is constructed from a round steel rod and has a flat screwdriver blade 16 at one end adapted to drive slotted screws and crossed and pointed Phillips blades 18 formed at the other end adapted to drive Phillips screws. Both the flat blade 16 and the Phillips blades 18 are conventional in construction and made by conventional forming techniques, and it is important to an understanding of the locking features of the present invention to know the specific shape of the straight blade 16 of the driver 12.

As seen in FIGS. 1, 3, 10, 13 and 14, the straight bladed end 16 includes forwardly converging top and bottom walls 20 and 21 that end at flat driver tip 22. The top and bottom walls 20 and 21 are struck or forged from the round driver shaft 25 and as a result of this deformation the blade end 16 is wider than the diameter of the driver rod 25 beginning at about a point designated 26 in FIGS. 1 and 13 where the top and bottom walls 20 and 21 begin. The top and bottom walls 20 and 21 may also be ground. Thereafter, side walls 29 and 30 are formed by stamping or grinding, and these walls converge forwardly from the widest axial point 33 on driver blade 16. Note that the side walls 29 and 30 are spaced further apart throughout their length than the diameter of driver shaft 25, although in some cases they may converge sufficiently to be closer together at tip 27 than the diameter of driver shaft 25.

The handle 11 has a closed end channel 35 of uniform cross-section for receiving both ends of the driver 12 as seen in FIGS. 1, 2 and 3. The shape of the channel 35 is an important aspect of the present invention and reference should be made to FIG. 14 which is an enlarged fragmentary section of the recess for an understanding of its cross-sectional shape. For purposes of illustration the channel or recess 35 in FIG. 14 is shown with the flat blade end of the driver positioned in the recess looking from the blade tip 27 axially toward the other end of the driver.

Figures 13, 14, 15, 16, 17, 18, 19, 20, 21:
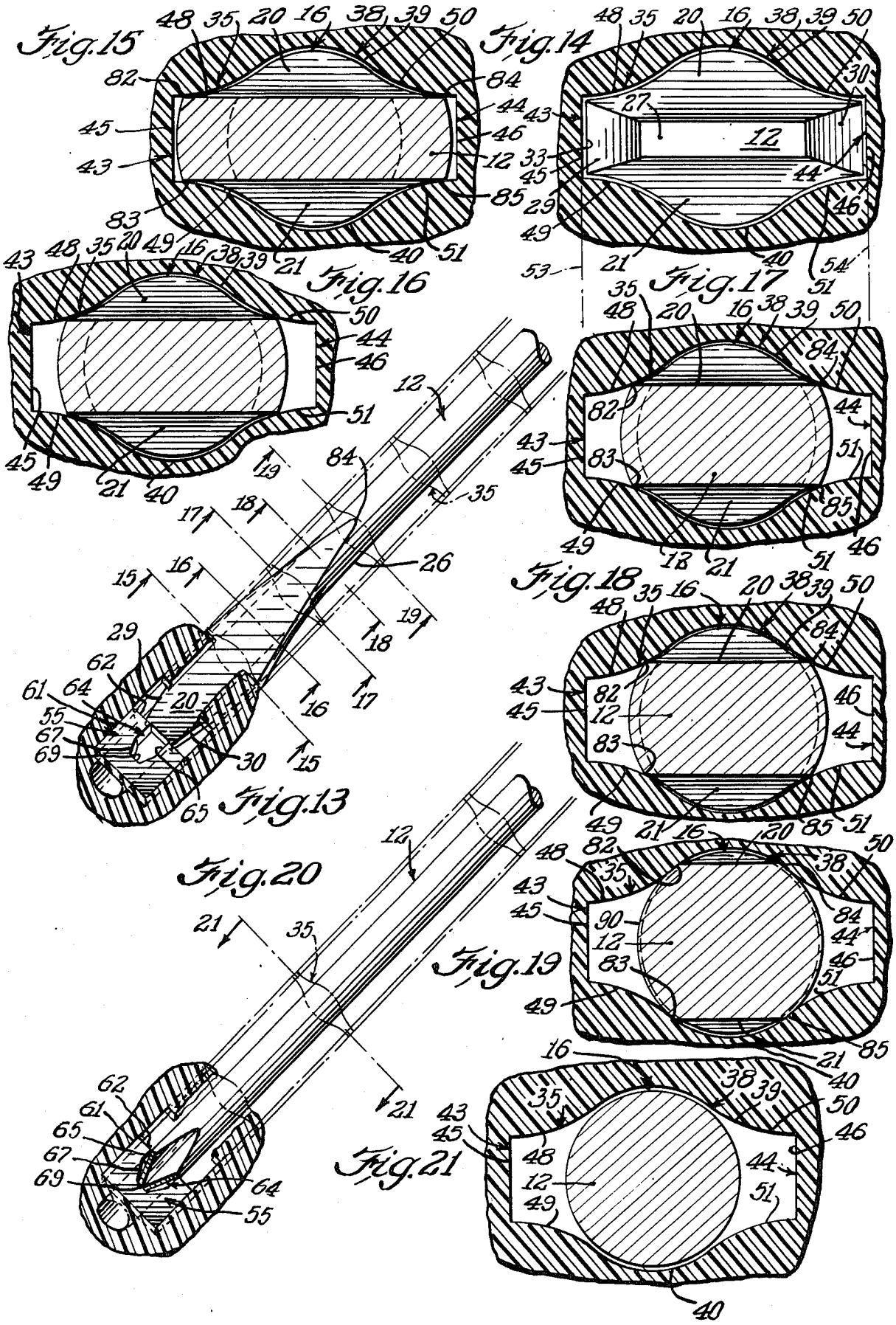
FIG. 13 is a fragmentary perspective view of the flat bladed end of the driver in the handle channel.
FIG. 14 is an enlarged cross-section of the handle channel with the driver removed.
FIG. 15 is a fragmentary section of the handle channel taken generally along line 15—15 of FIG. 13 at the widest part of the flat blade end of the driver.
FIG. 16 is a fragmentary section of the handle channel taken generally along line 16—16 of FIG. 13.
FIG. 17 is a fragmentary section of the handle channel taken generally along line 17—17 of FIG. 13.
FIG. 18 is a fragmentary section of the handle channel taken generally along line 18—18 of FIG. 13.
FIG. 19 is a fragmentary section of the handle channel taken generally along line 19—19 of FIG. 13.
FIG. 20 is a fragmentary perspective view of the Phillips end of the driver in the handle channel.
FIG. 21 is a fragmentary section of the handle channel taken generally along line 21—21 of FIG. 20.

As seen in FIG. 14, recess 35 in cross-section has a shape complementary to but slightly larger than and contiguous with the extreme outer periphery of the driver viewed axially from tip 27. Recess 35 includes a central portion 38 including arcuate segments 39 and 40 having identical radii about the geometric axis 42 of the channel 35, slightly larger than the radius of the driver shaft 25. Extending diametrically outwardly from central portion 38 are side recesses 43 and 44 having flat, parallel bottom walls 45 and 46 spaced slightly further apart then the maximum width of the driver blade at 33 (see FIGS. 1 and 13). The recesses 43 and 44 have reversely curved side walls 48, 49, 50 and 51, each defined by an arc tangent to one of the arcuate segments 39 and 40, having their centers 51 lying in one of the planes 53 and 54 extending through recess bottom walls 45 and 46. The bottom walls 45 and 46 of the channel recesses 43 and 44 have a width just slightly greater than the width of the blade side walls 29 and 30 at their maximum width position or point 33.

As seen in FIGS. 3 and 22, the side recesses 43 and 44 each have an axially converging portion 41 defined by forwardly and axially converging walls 47 and 52 that engage the top and bottom walls forwardly of the widest point 33 to assist in locking the driver from rotation.

It should be understood that the shape of the recess of channel 35 will vary slightly from one flat blade screwdriver configuration to another, but in all, the general shape of the channel will approximate that illustrated in FIG. 14, modified of course by the specific exterior outline of the blade employed, viewed from the blade tip.

A "U" shaped steel locking key 55 is pressed into the recess in engagement with recess bottom wall 56 as seen in FIG. 9. The locking key 55 has spaced parallel front and rear walls 57 and 58 interconnected by short side walls 60 and 61 and top and bottom walls 62 and 63. Key 55 has a central slot 64 defined by parallel side walls 65 and 66, converging forward walls 67 and 68 and a bottom wall 69. The side walls 65 and 66 are spaced apart so that they fit between and engage adjacent blades 70 and 71 of the Phillips end 18 of the driver as seen clearly in FIG. 6. The outside side walls 60 and 61 on the locking key are spaced apart substantially the same distance as channel recess bottom walls 45 and 46 so that the locking key 55 is held tightly in the recesses and thereby prevented from any rotational movement in the channel. The side walls 60 and 61 also have a width equal to the channel recess bottom walls 45 and 46 to produce a snug fit therein. When the Phillips end 18 of the driver is inserted into the channel 35, slot walls 65 and 66 fit between the blades 70 and 71 engage both walls of adjacent blades and securely lock the Phillips end of the driver in the handle from any rotation or wiggling movement.

The top wall 62 of the locking key serves as a stop for the blade tip 26 when the flat blade end of the driver is inserted into the handle as seen clearly in FIGS. 3 and 10. This prevents the end of the flat blade driver under axial loading from digging into any plastic material in the handle.

The handle 11 is provided with a pair of integral forwardly extending arcuate projections 72 and 73 for the purpose of gripping the driver 12 and holding it against axial movement after insertion into handle 11. The gripping projections or fingers 72 and 73 are integrally molded with handle 11 and are seen to have frusto-conical outer surfaces 75 and 76 and frusto-conical inner surfaces 77 and 78. The inner surfaces 77 and 78 converge inwardly from the diameter of the central portion 38 of recess 35 and the projections 72 and 73 are separated at 80 and 81 so they are somewhat resilient and are spread apart by the driver as either end of the driver is inserted into the handle 11.

Reference should now be made to FIGS. 13 to 19 for illustrations of the gripping engagement between the handle channel 35 and the flat blade end of the driver 12. As described above, the unique configuration of channel 35 provides gripping engagement with the side edges of the top and bottom walls 20 and 21 of the blade between the widest point of the blade at 33 and the near end 83 (see FIG. 18) of the walls.

FIG. 15 is a section of the channel 35 taken across the widest point of the first blade 16 and as seen the side walls of recesses 43 and 44 very near bottom walls engage the driver at points 82, 83, 84 and 85. FIG. 16 is a section of the channel 35 taken just rearwardly from the maximum width point 33 of the driver and there it is seen that recess side wall segments 48, 49, 50 and 51 continue to engage the edges of the top and bottom walls 20 and 21. Similarly in FIG. 16, a section taken further rearwardly from FIG. 16 along channel 35, the recess arcuate segments are seen to remain in engagement with the side edges of the top and bottom walls 20 and 21 to lock the driver from rotation at that location. Also, in FIG. 18, a section of the channel 35 taken still further rearwardly along driver 12, the recess segments 48, 49, 50 and 51 continue to engage the edges of the top and bottom walls 20 and 21 to prevent rotation of the driver in the housing. And even at a point just short of the rear ends of the top and bottom walls 20 and 21 as seen in FIG. 19, the channel central section segments 39 and 40 engage the side edges of the top and bottom walls 20 and 21 to resist rotation of the driver.

While the radii of the central portion of segments 39 and 40 are substantially equal to the radius of the driver shaft 25, the forming operation for the top and bottom walls 20 and 21 causes the driver to spread slightly laterally in the plane of FIG. 9 to a somewhat larger radius 90 so that the driver is unable to turn the plane of FIG. 19.

FIGS. 20 and 21 illustrate the Phillips end of the driver 12 in the channel 35.

I claim:

1. In a hand-held tool of the type having an elongated handle that reversely and alternately receives the ends of a round tool driver having a screwdriver blade at one end and another tool at its other end, where the screwdriver blade is formed by converging top and bottom flat surfaces with forwardly converging side surfaces spread further apart along at least part of their length than the diameter of the tool drive, said flat top and bottom surfaces extending rearwardly a substantial distance from the widest width of the blade, the improvement comprising: a slot extending axially in the handle and constructed to receive both the screwdriver blade and the other tool on the tool driver, said slot also being constructed to engage portions of the top and bottom surfaces of the blade to lock the blade and driver from rotation without any additional locking parts when the screwdriver blade end of the driver is inserted into the handle when using the other tool end of the driver, and said slot including a central segmental cylindrical portion and a pair of diametrically opposed axially extending generally rectangular recesses each having a width to engage and grasp the top and bottom flat surfaces of the blade in the area of the widest width of the blade, and said slot also having four axially extending constant radius convex surfaces connecting the segmental cylindrical portion of the slot and the rectangular recesses engaging and locking the edges of the top and bottom surfaces rearwardly of the widest width of the blade.

2. In a hand-held tool of the type having an elongated handle that reversely and alternately receives the ends of a round tool driver having a screwdriver blade at one end and another tool at its other end, where the screwdriver blade is formed by converging top and bottom flat surfaces with forwardly converging side surfaces spread further apart along at least part of their length than the diameter of the tool screwdriver, said flat top and bottom surfaces extending rearwardly a substantial distance from the widest width of the blade, the improvement comprising; a slot extending axially in the handle and constructed to receive both the screwdriver blade and the other tool on the tool driver, said slot also being constructed to engage portions of the top and bottom surfaces over a substantial axial length of the surfaces of the blade to lock the blade and driver from rotation without any additional locking parts when the screwdriver blade end of the driver is inserted into the handle when using the other tool end of the driver, and said slot including a central segmental cylindrical portion and opposed recesses, and four axially extending constant radius convex surfaces interconnecting the segmental cylindrical portion and the sides of the recesses engaging and locking the edges of the top and bottom surfaces rearwardly of the widest width of the blade.

3. In a hand-held tool as defined in claim 1, wherein the slot has a uniform cross-section throughout most of its length.

4. In a hand-held tool as defined in claim 1, wherein the recesses having outwardly converging portions.

5. In a hand-held tool, as defined in claim 1, wherein the other tool is a Phillips head screwdriver with blades formed on the other end of the driver, and a "U" shaped metal key inserted in the slot for holding the Phillips blades from rotation when that end of the driver is inserted into the handle.

6. In a hand-held tool, as defined in claim 5, wherein the key has a flat end that defines a stop for the driver blade when the flat end of the driver is inserted into the handle.

7. In a hand-held tool as defined in claim 1, wherein the handle has integral resilient inwardly extending fingers adjacent the outer end of the handle slot to grip the driver and hold it in the handle against axial movement.

8. A hand-held tool having a handle that reversely receives a screwdriver shaft having conventionally formed Phillips head blades at one end and a flat blade at its opposite end, where the flat blade is formed with two forwardly converging flat top and bottom walls and forwardly converging connecting side walls having a width greater at least at their lengths than the diameter of the driver shaft from which it is formed, said flat top and bottom walls extending rearwardly a substantial distance from the widest width of the blade, comprising; an elongated molded plastic handle with an elongated core molded slot therein adapted to receive either end of the driver, said slot having in cross-section a segmental circular portion and diametrically opposed side recesses, a locking key in the inner end of the slot engaged in the side recesses to prevent rotation thereof, said locking key having a recess therein so that the Phillips blades may extend into the key to lock the driver from rotation when that end of the driver is in the handle, and said slot including a central segmental cylindrical portion and opposed recesses, and four axially extending constant radius convex surfaces interconnecting the cylindrical portion and the sides of the recesses engaging and locking the edges of the top and bottom walls rearwardly of the widest width of the blade.

9. A hand-held tool as defined in claim 8, wherein the locking key is "U" shaped in configuration with the bottom of the "U" engaging the bottom of the slot.

10. A hand-held combination tool of the type having a plastic handle adapted to receive either end of a screwdriver having a flat blade at one end and another tool at the other end, where the flat blade end is formed by flattening and spreading a driver shaft which is circular in cross-section to form converging flat top and bottom walls and then forming connecting forwardly converging side walls spaced further apart through at least most of their length than the diameter of the driver shaft, said top and bottom walls extending rearwardly a substantial distance from the widest width of the blade, the improvement comprising an elongated recess in the handle for receiving both ends of the screwdriver having a cross-section through its length complementary with the extreme outer periphery or silhouette of the screwdriver when viewed axially and not in section from the flat blade end thereof, so that the slot engages the flat blade over a substantial axial length thereof rearwardly of the widest width of the blade to prevent relative rotation between the driver and the handle.

11. A hand-held tool as defined in claim 10, wherein the other end of the driver has Phillips screw blades formed thereon, and a metal "U" shaped locking key in slot for receiving and holding the Phillips blade on the other end of the driver.

* * * * *